US005193234A

United States Patent [19]

Joaquin

[11] Patent Number: 5,193,234

[45] Date of Patent: Mar. 16, 1993

[54] FOLDING COT FOR INFANTS

[75] Inventor: Jane L. Joaquin, Barcelona, Spain

[73] Assignee: Play S.A., Barcelona, Spain

[21] Appl. No.: 817,804

[22] Filed: Jan. 9, 1992

[30] Foreign Application Priority Data

Feb. 26, 1991 [ES] Spain ..... 9100484
Oct. 15, 1991 [ES] Spain ..... 91002267

[51] Int. Cl.[5] ..... A47D 7/00
[52] U.S. Cl. ..... 5/99.1
[58] Field of Search ..... 5/99.1, 98.1, 98.2, 5/93.1

[56] References Cited

U.S. PATENT DOCUMENTS 2,991,486 7/1991 Hamilton ..... 5/99.1
4,070,716 1/1978 Satt et al. ..... 5/98.1
4,635,305 1/1987 Wyss ..... 5/99.1

FOREIGN PATENT DOCUMENTS 0175816 2/1986 European Pat. Off. .
267993 9/1982 Spain .
204320 5/1988 Taiwan .
201747 9/1989 Taiwan .

*Primary Examiner*—Alexander Grosz
*Attorney, Agent, or Firm*—Cushman, Darby & Cushman

[57] ABSTRACT

This cot comprises an upper frame (1,1') of long rods (13) which are split and jointed to a central block (3) to which are also jointed the U-shaped legs (5 and 5') with telescopic members (9,10), and is characterized in that the long rods (21) of the base frame (20), are split and jointed at the ends such that when the legs (5 and 5') are folded in to face each other, the halves of the upper frame (1,1'), the halves of the base frame (20) and the resulting upper sections may be folded inwards around 90° to overlap each other, thus reducing by two thirds the volume obtained using the conventional method of folding these cots. The base frame (20) can be attached to crossmembers (19) of the legs (5 and 5') to allow removal of the flexible receptacle (27) which forms the sides of the cot, the housing (22) of the central joint of the long rods of said frame having a support foot (23) attached underneath.

4 Claims, 3 Drawing Sheets

FOLDING COT FOR INFANTS

BACKGROUND AND DESCRIPTION OF THE PRIOR ART

The invention refers to a folding cot for infants.

For people who have to travel with young babies, there are on the market different models of folding cots, some of which are more complete than others and some more complex, both in structure and means of folding.

Among the simpler, easy-to-manage types of folding cot is Spanish Utility Model nº 267.993 from the same applicant firm, in which model the upper frame and base are jointed in the middle and the legs, for greater folding capacity, are telescopic, which reduces the height of the folded unit quite a lot. Nevertheless, it is still very bulky, for example, for carrying the cot in the boot of the car.

SUMMARY OF THE INVENTION

In order to get the cot to fold up more compactly and less bulkily, the upper frame, legs and base frame now also have jointed end sections, making the volume of the folded cot about one third that of the former model.

To get this result, the end sections of the long rods of the upper frame and base frame, and of the legs, are split and jointed in such a way that when the legs and the two articulated halves of the upper and base frames are folded round to face each other, the resulting upper sections of said long rods and of the legs can be folded inwards about 90° to overlap each other.

For detachable mounting of the flexible receptacle that will form the sides of the cot, the base frame has been designed for easy coupling/uncoupling to crossmembers at the lower part of the legs, the frame being split in the middle of its long rods and jointed to a housing which has a support foot underneath.

To delimit the movement of the outer tube relative to the inner tube of the telescopic portions of the legs, to avoid accidental separation thereof and at the same time get the relative movement of the tubes to be smooth and silent, a longitudinal groove has been formed in the inner tube of the telescopic portions of the legs, an internal projection of the outer tube being engaged in said groove, with a bushing of self-lubricated material being disposed between said two tubes.

It has also been contemplated to provide the cot with means ensuring stability thereof in use, for which purpose respective arms are pivoted at points on the end regions of the base portion of the legs, said arms extending beyond the arms of the U in their unfolded position.

These and other characteristics are made clearer by the detailed description that follows and the accompanying drawings showing an embodiment which is given only as a non-limiting example of the scope of the invention.

DETAILED DESCRIPTION OF THE INVENTION

Figure 5:
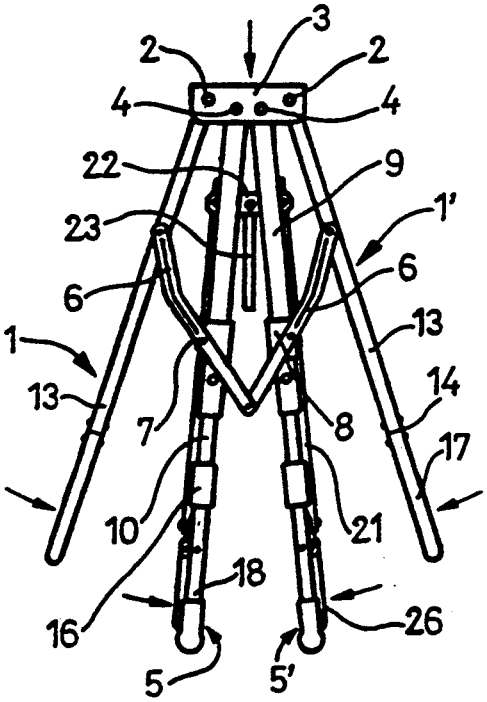
FIG. 5 shows a frontal elevation of the first stage of folding.

In accordance with the drawings, the folding cot for infants referred to in this invention consists of an upper frame made up of two identical "U"-shaped members 1 and 1', jointed via respective pins 2 to a block 3 to which the cot's "U"-shaped legs 5 and 5' are also jointed via pins 4, the respective ties 6 being jointed between the frame and the legs and the articulating around a central point 7 in leg sliding bushings 8, said tension members permitting the first-stage folding of the cot (FIG. 5).

The legs, 1, 1' and 5, 5' when opened for use, stand obliquely, are "U"-shaped and are telescopic, with an inner tube 10 that slides inside an outer tube 9 to reduce the height of the cot in the first stage of the folding process.

To stabilise the unfolded or extended position of the legs, some fastenings have been fitted between the two tubes 9 and 10, for example a hole 11 in the outer tube 9 and a spring retainer with detent 12 on the inner tube 10. This method of fastening can be unblocked by pressing dentents 12.

Figure 1:
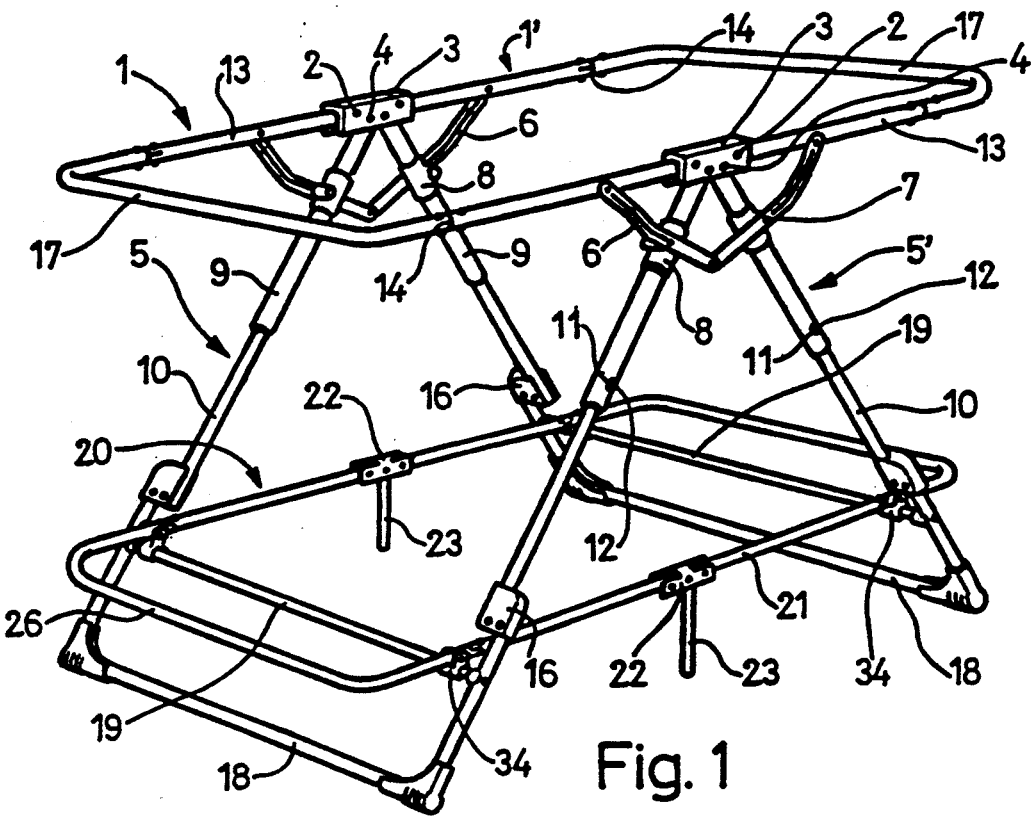
FIG. 1 is a perspective view of the cot frame assembly.
Figure 2:
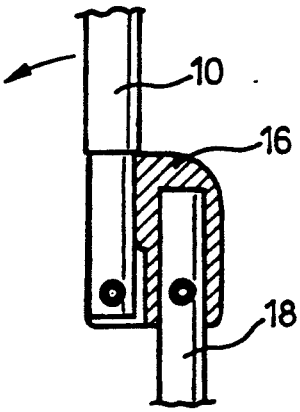
FIGS. 2, 3 and 4 show details of the joints on the lower part of the legs, on the upper frame and on the base frame.
Figure 3:
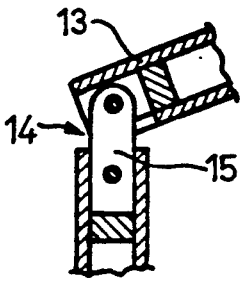

The long rods 13 of the upper frame are split and jointed at the ends 14 by means of an internal spigot 15 (FIG. 3), and the legs, also at the ends, are split and jointed to a block 16, both these members forming U-shaped ends 17 and 18. This enables the resulting upper sections of the legs and long rods of the top frame to be folded inwards, together with the ties 6, around 90° until they are overlapping each other.

Figure 4:
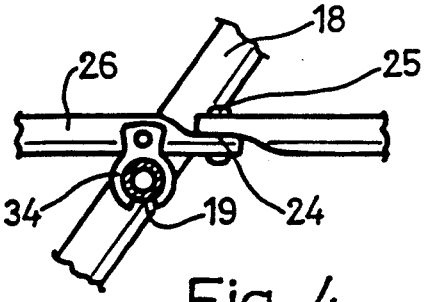

The crossmembers 19 on the lower part of the legs take the detachable frame 20 for the board making up the cot base, the long rods 21 of the frame being jointed to a housing 22 which has a support foot 23 attached to it underneath. At the ends 24 (FIG. 4), these long rods are split and jointed around a pin 25, forming "U"-shaped ends 26, which in the second phase enables the upper sections of said long rods to be folded inwards (FIG. 6) about 90°, to face each other underneath the upper sections of the legs and long rods of the upper frame.

Figure 8:
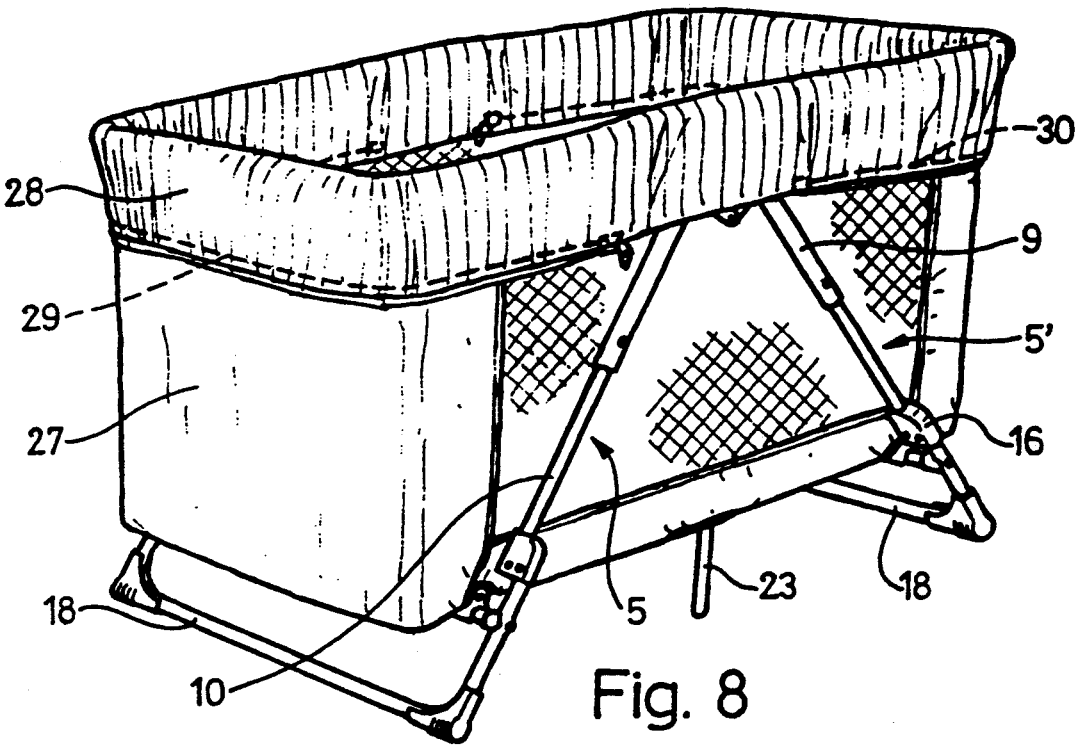

The board forming the cot base (not shown) will preferably be made up in three separate parts, two ends which will be fixed on the "U"-shaped members 26, and a middle piece jointed in three or four transverse sections and that may be removed from its support on the long rods 21 of the frame 20.

Where it overlaps, the flexible receptacle 27 forms a broad apron 28 around the edge (FIG. 8) which covers the upper frame 1-1' and which has zip fasteners 29 and 30 on the rim for attaching it to the body of the receptacle, the bottom of which has openings 31, 32 and 33 to take the clamps 34 (FIG. 4) for fixing the frame 20 to the crossmembers 19 and the support feet 23. This allows the flexible receptacle to be removed for washing or repair.

Figure 9:
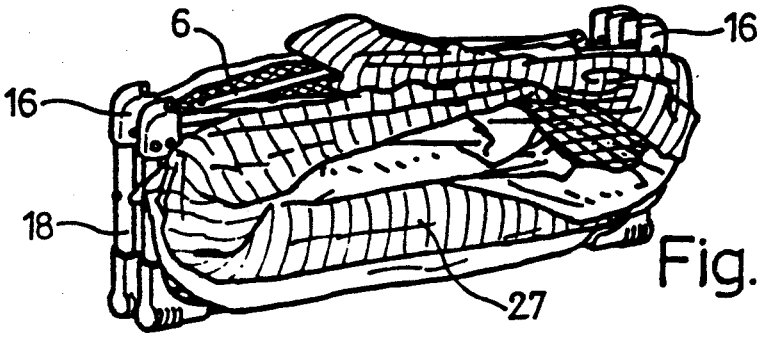

Once the central part of the base-board, also foldable, has been removed, the cot can then be folded up really small, as shown in FIG. 9.

The cot is provided, between the outer tube 9 and the inner tube 10, which form the telescopic unit of the U-shaped leg portions, with the arrangement of a bushing 35 of self-lubricated material, such as nylon, determining a perfect fit between said tubes and the silent sliding of one over the other.

This bushing is attached to the inner tube 9 by a rivet 36 forming a projecting head 37 in the interior of said tube and which slides in a swaged groove 38 formed longitudinally in the inner tube 10, whereby it is achieved that the two tubes forming the telescopic unit do not come apart when being extended.

The U-shaped ends 18, pivoted by the block 16 to the telescopic portions of the legs, have pivotably mounted thereon at the end regions of the base portion 18', by a shaft 39, respective half round arms 40, which in the unfolded position thereof extend from the portions of the legs, increasing the cot support base.

Figures 10, 11, 12, 13:
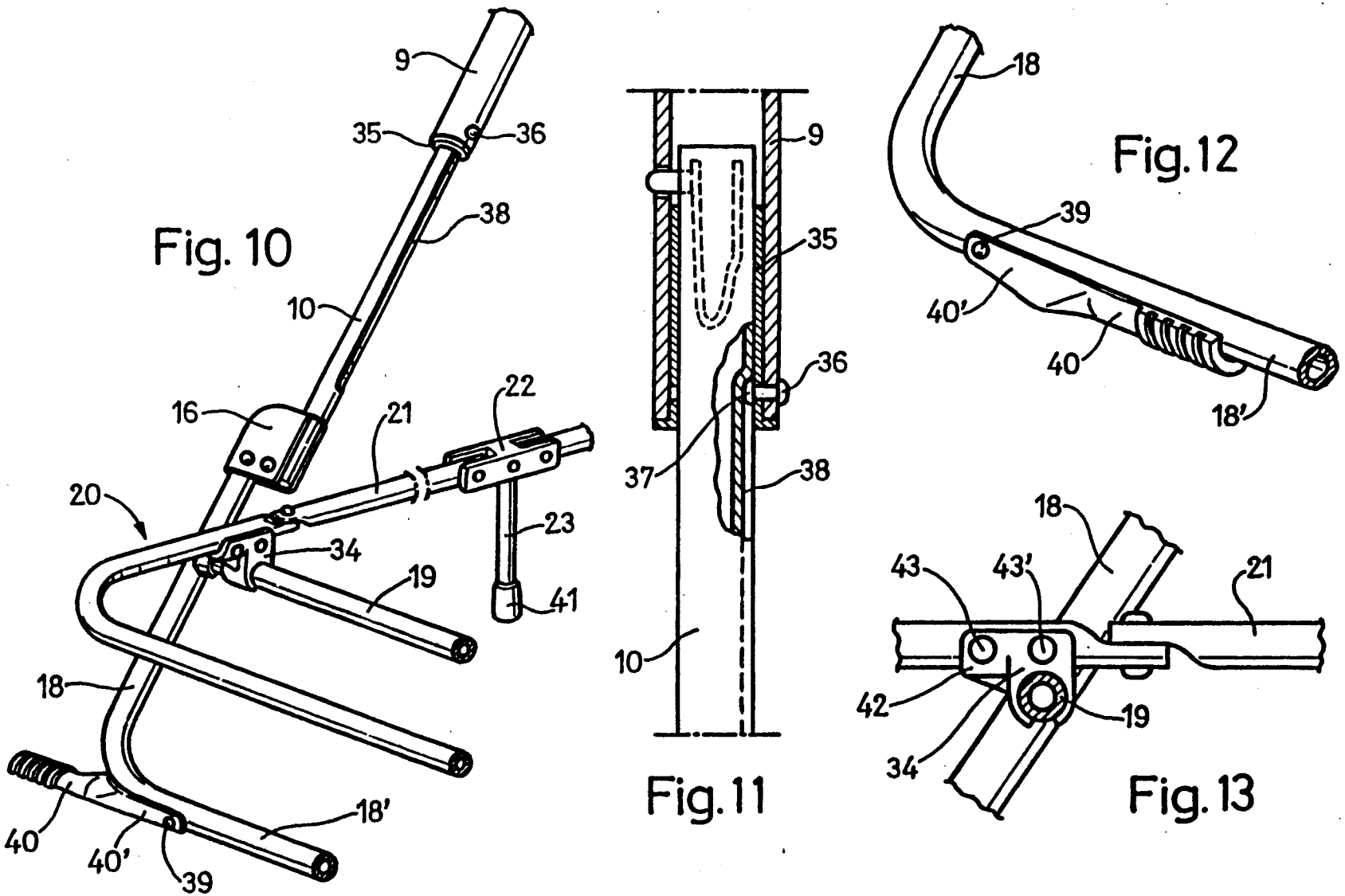
FIG. 10 is a perspective view of a detail of one of the legs of the cot.
FIG. 11 is an elevation view in cross section of the coupling between the two telescopic tubes of the legs.
FIG. 12 is a perspective view of a detail of one of the stabiliser arms in the folded position.
FIG. 13 is an elevation view of a detail of the coupling of the base board frame to the legs.

These arms 40 are provided, at the pivoted end thereof, with a fork 40' and the half round section thereof allows them to be folded juxtapositioned under the base portions 18' having a cylindrical tubular section (FIG. 12).

The reference numeral 41 indicates the end cap for the support feet 23 fixedly attached to the boxes 22 which are pivoted to the two halves of the split rods 21 of the base board frame 20 and the reference numeral 42 indicates (FIG. 13) an extension of the base of the clamps 34 with which the base board frame 30 is held to the crossmembers 19 of the lower region of the legs. Said extension allows said clamps to be attached to the frame by two attachment points 43 and 43'.

Figure 6:
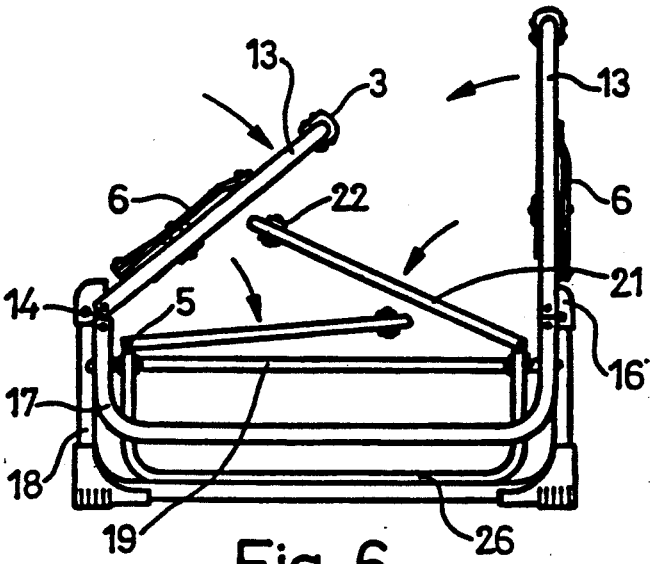
FIG. 6 shows a side elevation of the second stage of folding.
Figure 7:
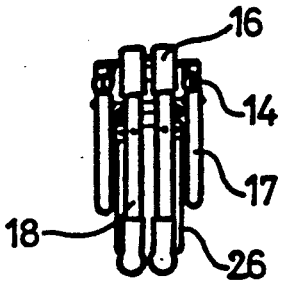
FIG. 7 shows a end elevation of the frame completely folded, and FIGS. 8 and 9 give perspective views of the cot unfolded and folded, respectively.

To summarize the folding steps, after the cot has been folded to the condition shown in FIG. 5, as shown in FIG. 6, the inner arms 20 and 21 are each folded inwardly toward eachother as shown in FIG. 6 followed by the outer arms 1 and 1'. With both the outer arms folded downwardly to a horizontal position as shown in FIG. 6, the fully folded cot appears as shown in FIG. 7.

I claim:

1. A folding cot or crib for infants comprising an upper frame means including a first U-shaped member having free ends each pivotally connected to one of a spaced apart pair of block members and a second U-shaped member having free ends each pivotally connected to a said respective one of said block members, support frame means including a second pair of U-shaped frame members each having a first and second leg with said first and second legs each having a telescoping collapsible portion, said second pair each having an outer U-shaped portion having leg portions pivotally connected to a said respective telescoping portion of said first and second legs, each telescoping portion having an end pivotally connected to a said respective block member so as to permit folding of said upper frame and support frame means relative to said block members to bring said first and second frame members and said second pair of frame members toward each other and to permit said telescoping portions and said block members to be folded inwardly towards each other through an angle of approximately 90° to at least partially overlap each other.

2. The invention as claimed in claim 1, wherein a third frame member is provided and includes two substantially U-shaped portions each having a first and second leg having free ends pivotally mounted in respective spaced apart block elements; each of said U-shaped portions having ends remote from said block elements with said remote ends being pivotally connected to said first and second legs of each said portion of said third frame member.

3. The invention as claimed in claim 1, wherein said telescoping portions of said leg members include an inner tube having a longitudinal groove and an outer tube, said outer tube having an aperture receiving a detent member, said detent member having an inner end received in said groove of said inner tube, a bushing being disposed about said inner tube and within said outer tube, said bushing being of self-lubricating material to permit silent sliding between said inner and outer tubes.

4. The invention as claimed in claim 1, wherein each of said U-shaped portions of said support frame member, remote from said block members includes a foot member pivotally mounted thereon to be pivoted between a retracted and an extended position to provide a larger support base for said folding cot.

* * * * *